US010335001B1

(12) United States Patent
Hu et al.

(10) Patent No.: US 10,335,001 B1
(45) Date of Patent: Jul. 2, 2019

(54) DUST COLLECTION BOX AND ROBOT VACUUM CLEANER

(71) Applicants: JIANGSU MIDEA CLEANING APPLIANCES CO., LTD., Suzhou (CN); MIDEA GROUP CO., LTD., Foshan (CN)

(72) Inventors: Wei Hu, Suzhou (CN); Xianmin Wei, Suzhou (CN); Manzhi Jin, Suzhou (CN)

(73) Assignees: JIANGSU MIDEA CLEANING APPLIANCES CO., LTD., Suzhou (CN); MIDEA GROUP CO., LTD., Foshan (CN)

( * ) Notice: Subject to any disclaimer, the term of this patent is extended or adjusted under 35 U.S.C. 154(b) by 0 days.

(21) Appl. No.: 16/131,001

(22) Filed: Sep. 13, 2018

Related U.S. Application Data

(63) Continuation of application No. PCT/CN2018/098032, filed on Aug. 1, 2018.

(30) Foreign Application Priority Data

Mar. 8, 2018 (CN) ..... 2018 2 0321909 U

(51) Int. Cl.
*A47L 9/10* (2006.01)
*A47L 9/14* (2006.01)
*A47L 9/20* (2006.01)

(52) U.S. Cl.
CPC ..... *A47L 9/149* (2013.01); *A47L 9/106* (2013.01); *A47L 9/1409* (2013.01); *A47L 9/1463* (2013.01); *A47L 9/20* (2013.01); *A47L 9/10* (2013.01); *A47L 2201/00* (2013.01)

(58) Field of Classification Search
CPC ..... A47L 9/10; A47L 9/16; A47L 9/20
See application file for complete search history.

(56) References Cited

U.S. PATENT DOCUMENTS

2006/0037172 A1 2/2006 Choi
2017/0273532 A1* 9/2017 Machida ..... A47L 9/10

FOREIGN PATENT DOCUMENTS

CN 101637372 A 2/2010
CN 201404164 Y 2/2010
CN 201431419 Y 3/2010
CN 102138764 A 8/2011
(Continued)

OTHER PUBLICATIONS

International Search Report dated Dec. 13, 2018 in the corresponding CN application (application No. PCT/CN2018/098032).

*Primary Examiner* — Michael D Jennings
(74) *Attorney, Agent, or Firm* — Kilpatrick Townsend & Stockton LLP

(57) ABSTRACT

Embodiments can provide a dust collection box and a robot vacuum cleaner. The dust collection box includes a box body and a lower lid. The box body defines a dust extraction port in the bottom thereof. The lower lid includes a first lateral portion and a second lateral portion opposite to each other. The first lateral portion is rotatably connected with the box body to enable the lower lid to open or close the dust extraction port. When the lower lid closes the dust extraction port, the second lateral portion is snap-fitted with the box body through a first snap structure.

19 Claims, 3 Drawing Sheets

(56) References Cited

FOREIGN PATENT DOCUMENTS

| | | | | |
|---|---|---|---|---|
| CN | 202173359 | U | | 3/2012 |
| CN | 102578967 | A | | 7/2012 |
| CN | 202751335 | U | | 2/2013 |
| JP | 2008295719 | A | * | 12/2008 |
| JP | 2010057653 | A | * | 3/2010 |
| JP | 2010063661 | A | * | 3/2010 |
| TW | 201735850 | A | | 10/2017 |

* cited by examiner

DUST COLLECTION BOX AND ROBOT VACUUM CLEANER

PRIORITY

This application is a continuation of International Application No. PCT/CN2018/098032, filed Aug. 1, 2018, which claims priority to and the benefit of Chinese Patent Application No. 201820321909.0 filed in the China's State Intellectual Property Office on Mar. 8, 2018, the entire contents of which are incorporated herein by reference.

FIELD

The present disclosure relates to a technical field of robot vacuum cleaners, and more particularly to a dust collection box and a robot vacuum cleaner.

BACKGROUND

In daily life, a robot vacuum cleaner satisfies a basic requirement of a user for cleaning the floor, but after a dust collection box in the robot vacuum cleaner is filled with pollutants like rubbish, the user needs to perform complicated operations to remove the garbage in the dust collection box, which is extremely inconvenient.

SUMMARY

Embodiments of the present disclosure provide a dust collection box and a robot vacuum cleaner.

The dust collection box according to embodiments of the present disclosure includes: a box body defining a dust extraction port in a bottom of the box body; and a lower lid including a first lateral portion and a second lateral portion opposite to each other, the first lateral portion being rotatably connected with the box body to enable the lower lid to open or close the dust extraction port, and when the lower lid closes the dust extraction port, the second lateral portion being snap-fitted with the box body through a first snap structure, and the lower lid being used to carry pollutants.

In some embodiments, the lower lid includes a bottom wall and a lateral wall extending from an edge of the bottom wall, and the bottom wall and the lateral wall enclose a groove; when the lower lid closes the dust extraction port, the bottom of the box body stretches into the groove, and the lateral wall surrounds the bottom of the box body.

In some embodiments, the box body defines a dust collecting chamber in communication with the dust extraction port; the lower lid includes a bump fixed on the bottom wall and received in the groove; when the lower lid closes the dust extraction port, the bump extends into the dust collecting chamber and fills a bottom of the dust collecting chamber.

In some embodiments, the box body includes an outer peripheral surface and a bottom surface connected with the outer peripheral surface, and a receiving groove is defined at a joint of the outer peripheral surface and the bottom surface; when the lower lid closes the dust extraction port, the lateral wall is received in the receiving groove, and the outer peripheral surface is smoothly transitioned to an outer side of the lateral wall.

In some embodiments, the dust collection box includes a button, the button includes a rotating shaft, and the button is rotatably arranged to the box body through the rotating shaft; the first snap structure includes a hook formed at an end of the button and a snapping part formed at the second lateral portion; the button is able to swing, with respect to the box body, between a first position and a second position. When in the first position, the hook is snap-fitted with the snapping part to make the lower lid close the dust extraction port.

In some embodiments, the hook includes a snapping surface facing upwards, the snapping part includes a snapping bar, and in the first position, the snapping bar abuts against the snapping surface.

In some embodiments, the button includes a press board, and the rotating shaft is fixed in a middle position of the press board; the press board includes a first swing end and a second swing end located at two opposite sides of the rotating shaft respectively; the hook forms the first swing end, the first swing end swings towards a direction away from the box body, and the second swing end swings towards a direction approaching the box body; and the box body defines a void space available for the second swing end to swing.

In some embodiments, a top of the box body defines an opening in communication with the dust extraction port, and the dust collection box further includes an upper lid detachably arranged to the top of the box body and covering the opening.

In some embodiments, the upper lid is connected with the box body through a second snap structure.

The robot vacuum cleaner according to embodiments of the present disclosure includes a casing and the dust collection box according to any one of the above embodiments. The dust collection box is arranged in the casing.

Additional aspects and advantages of the present disclosure will be given in part in the following descriptions, become apparent in part from the following descriptions, or be learned from the practice of the embodiments of the present disclosure.

BRIEF DESCRIPTION OF THE DRAWINGS

These and/or other aspects and advantages of the present disclosure will become apparent and more readily appreciated from the following descriptions of embodiments made with reference to the drawings, in which.

Figure 1:
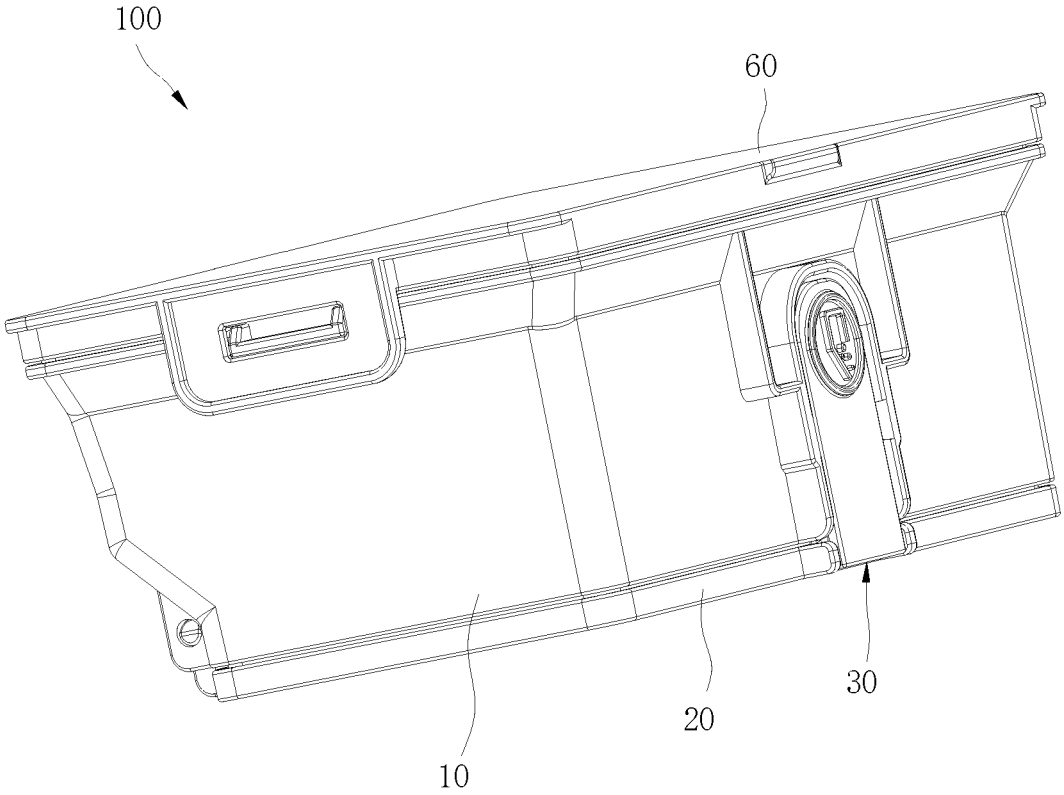
FIG. 1 is a perspective view of a dust collection box according to an embodiment of the present disclosure.

MAIN REFERENCE NUMERALS dust collection box 100, box body 10, dust extraction port 11, air inlet 12, air outlet 13, dust collecting chamber 14, outer peripheral surface 15, bottom surface 16, receiving groove 17, lower lid 20, first lateral portion 21, second lateral portion 22, bottom wall 23, lateral wall 24, groove 25, bump 26, first snap structure 30, hook 31, snapping surface 311, snapping part 32, snapping bar 321, filter device 40, button 50, rotating shaft 51, press board 52, first swing end 521, second swing end 522, upper lid 60, second snap structure 70, robot vacuum cleaner 200, casing 210.

DETAILED DESCRIPTION

Reference will be made in detail to embodiments of the present disclosure. Examples of the embodiments are shown in the drawings. The same or similar elements and the elements having same or similar functions are denoted by like reference numerals throughout the descriptions. The embodiments described herein with reference to drawings are explanatory, illustrative, and used to generally understand the present disclosure. The embodiments shall not be construed to limit the present disclosure.

In the specification, it is to be understood that terms such as "central," "longitudinal," "transverse," "length," "width," "thickness," "upper," "lower," "front," "rear," "left," "right," "vertical," "horizontal," "top," "bottom," "inner," "outer," "clockwise," and "counterclockwise" should be construed to refer to the orientation as then described or as shown in the drawings under discussion. These relative terms are for convenience of description and do not require that the present disclosure have a particular orientation or be constructed or operated in a particular orientation. Thus, these terms cannot be constructed to limit the present disclosure. In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present disclosure, "a plurality of" means two or more than two, unless specified otherwise.

In the description of the present disclosure, it should be understood that, unless specified or limited otherwise, the terms "mounted," "connected," and "coupled" and variations thereof are used broadly and may be, for example, fixed connections, detachable connections, or integral connections; may also be mechanical or electrical connections; may also be direct connections or indirect connections via intervening structures; may also be inner communications or interaction of two elements, which can be understood by those skilled in the art according to specific situations.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Various embodiments and examples are provided in the following description to implement different structures of the present disclosure. In order to simplify the present disclosure, certain elements and settings are described above. However, these elements and settings are only by way of example and are not intended to limit the present disclosure. In addition, reference numerals and/or reference letters may be repeated in different examples in the present disclosure. This repetition is for the purpose of simplification and clarity, and does not refer to relations between different embodiments and/or settings. Furthermore, examples of different processes and materials are provided in the present disclosure. However, it would be appreciated by those skilled in the art that other processes and/or materials may be also applied.

Figure 2:
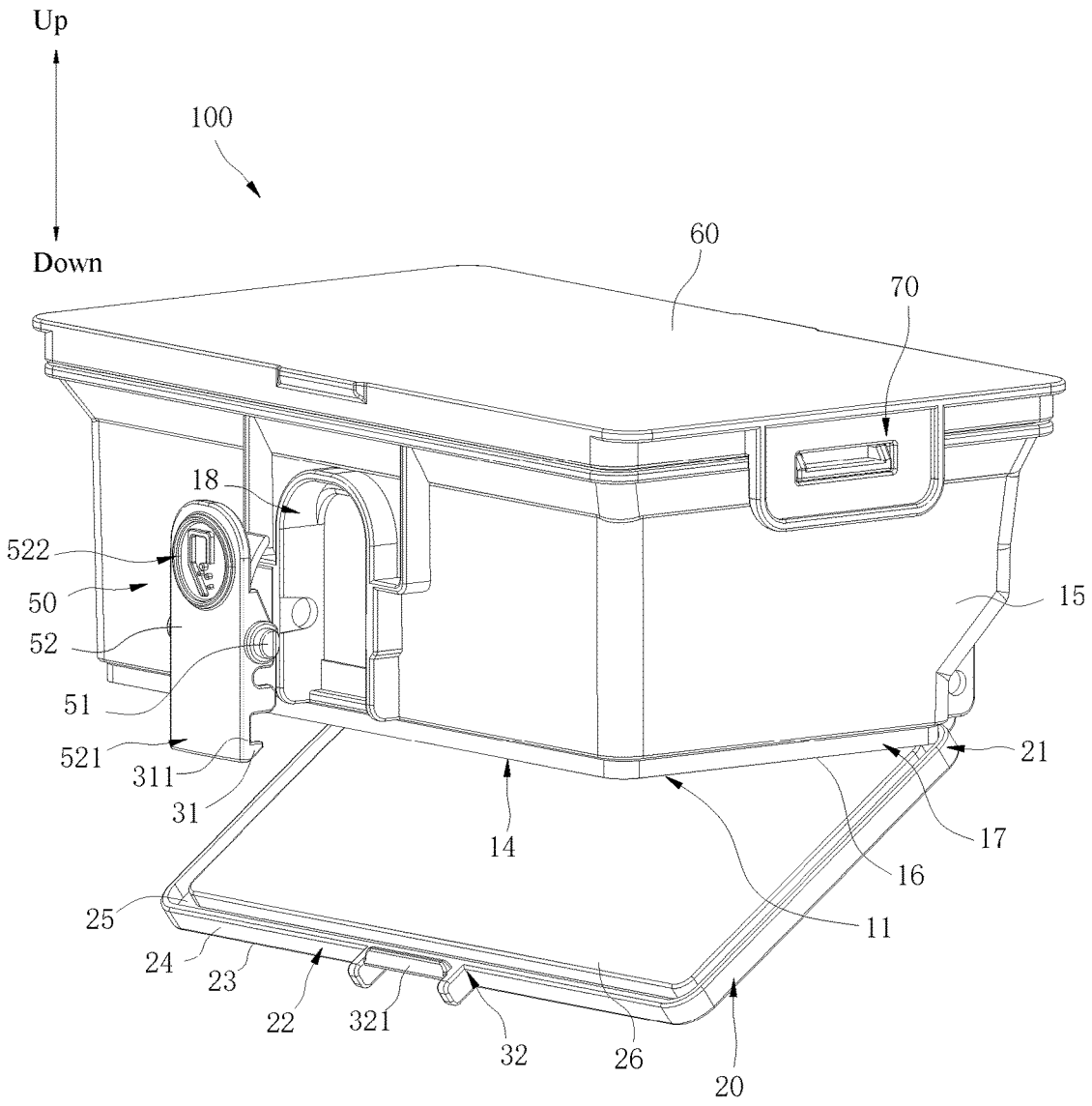
FIG. 2 is a perspective exploded view of a dust collection box according to an embodiment of the present disclosure.

Referring to FIGS. 1 and 2, a dust collection box 100 according to the present disclosure includes a box body 10 and a lower lid 20. The box body 10 comprises a dust extraction port 11 in a bottom of the box body 10. The lower lid 20 includes a first lateral portion 21 and a second lateral portion 22. The first lateral portion 21 is rotatably connected with the box body 10 to make the lower lid 20 open or close the dust extraction port 11. When the lower lid 20 closes the dust extraction port 11, the second lateral portion 22 is snap-fitted with the box body 10 through a first snap structure 30. The lower lid 20 is used to carry pollutants.

Figure 4:
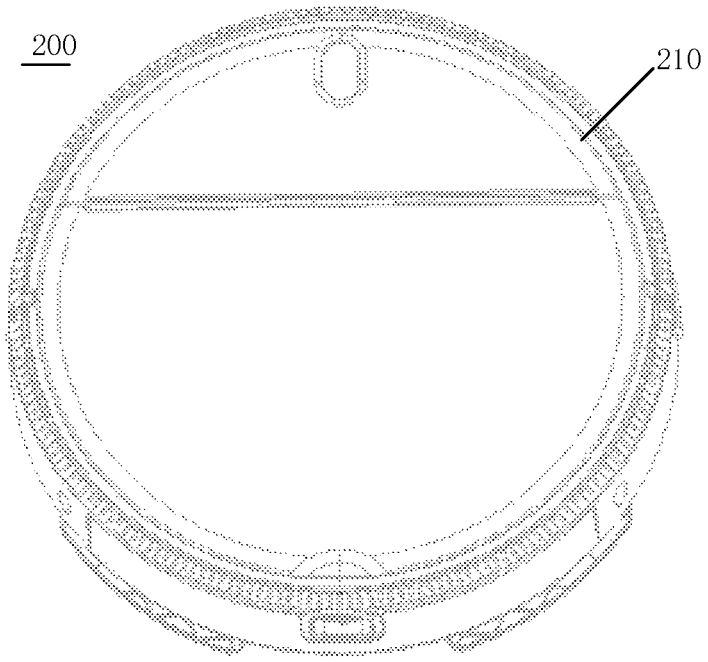
FIG. 4 is a plan view of a robot vacuum cleaner according to an embodiment of the present disclosure.

Referring to FIG. 4, the dust collection box 100 can be applied in a robot vacuum cleaner 200. Specifically, the robot vacuum cleaner 200 includes a casing 210, and the dust collection box 100 is arranged in the casing 210.

In the dust collection box 100 and the robot vacuum cleaner 200 discussed above, the lower lid 20 is connected with the box body 10 through the first snap structure 30, such that opening lower lid 20 can easily expose the dust extraction port 11, and dust or other rubbish in the box body 10 can be removed from the box body 10, which is convenient to operate.

In some embodiments, when the dust in the robot vacuum cleaner 200 is emptied, the dust collection box 100 is first taken out from the robot vacuum cleaner 200, the snap-fit relationship between the lower lid 20 and the box body 10 is released, such that the lower lid 20 can rotate to open the dust extraction port 11 and hence the dust carried by the lower lid 20 flows out of the box body 10 along with the rotation of the lower lid 20. In such a way. In this way, it is unnecessary to take out a filter device from the box body 10 during the removal of pollutants, which facilitates the cleaning process.

Figure 3:
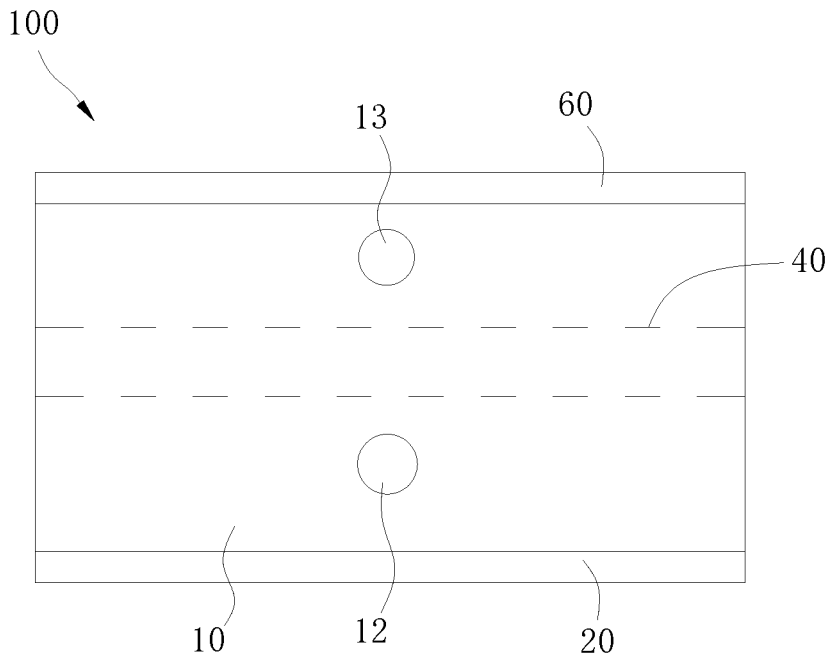
FIG. 3 is a side view of a dust collection box according to an embodiment of the present disclosure.

Referring to FIG. 3, the box body 10 defines an air inlet 12 and an air outlet 13, and the air inlet 12 and the air outlet 13 may be located at the same lateral surface of the box body 10. The air inlet 12 is located in a lower portion of the box body 10, while the air outlet 13 is located in an upper portion of the box body 10. The box body 10 is internally provided with a filter device 40, and the filter device 40 is located between the air inlet 12 and the air outlet 13. When the robot vacuum cleaner 200 operates, an air flow is formed between the air inlet 12 and the air outlet 13, and the dust and other pollutants enter the box body 10 from the air inlet 12 along with the air flow. Due to a filtration effect of the filter device 40, the pollutants are blocked from flowing to the air outlet 13 and instead remain in the box body 10, whereby a the dust can be emptied out.

The first lateral portion 21 can be rotatably connected to the box body 10 in the following manner. For example, the first lateral portion 21 is provided with a rotating shaft, the box body 10 is provided with a rotating hole, and the rotating shaft is received in the rotating hole to realize the rotatable connection between the first lateral portion 21 and the box body 10.

It should be noted that a bottom direction is a downward direction illustrated in FIG. 2, and a top direction is an upward direction illustrated in FIG. 2.

Referring to FIGS. 1 and 2 again, in some embodiments, the lower lid 20 includes a bottom wall 23 and a lateral wall 24 extending from an edge of the bottom wall 23, and the bottom wall 23 and the lateral wall 24 enclose a groove 25. When the lower lid 20 closes the dust extraction port 11, the bottom of the box body 10 stretches into the groove 25, and the lateral wall 24 surrounds the bottom of the box body 10.

Thus, the lateral wall 24 surrounds the bottom of the box body 10, so that the dust extraction port 11 is covered more tightly, the pollutants are prevented from flowing out of the dust extraction port during the dust collection process, which may otherwise pollute internal components of the robot vacuum cleaner 200, and the service life of the robot vacuum cleaner 200 is prolonged.

In some embodiments, as shown, the box body 10 comprises a dust collecting chamber 14 in communication with the dust extraction port 11. The lower lid 20 includes a bump 26 fixed on the bottom wall 23 and received in the groove 25. When the lower lid 20 closes the dust extraction port 11, the bump 26 extends into the dust collecting chamber 14 and fills the bottom of the dust collecting chamber 14. Thus, the bump 26 can further improve tightness of the dust extraction port 11 to prevent the pollutants from flowing out of the box body 10.

In some embodiments, the box body 10 includes an outer peripheral surface 15 and a bottom surface 16 connected with the outer peripheral surface 15, and a receiving groove 17 is defined at a joint of the outer peripheral surface 15 and the bottom surface 16. When the lower lid 20 closes the dust extraction port 11, the lateral wall 24 is received in the receiving groove 17, and the outer peripheral surface 15 is smoothly transitioned to an outer side of the lateral wall 24. As a result, the lower lid 20 is connected to the box body 10 in a smooth transition, such that the periphery of the dust collection box 100 is smoother, which is advantageous to mounting the dust collection box 100 into the robot vacuum cleaner 200 or removing the dust collection box 100 from the robot vacuum cleaner 200.

In some embodiments, the dust collection box 100 includes a button 50. The button 50 includes a rotating shaft 51 and is rotatably arranged to the box body 10 through the rotating shaft 51. The first snap structure 30 includes a hook 31 formed at an end of the button 50 and a snapping part 32 formed at the second lateral portion 22. The button 50 can swing between a first position and a second position with respect to the box body 10. In the first position, the hook 31 is snap-fitted with the snapping part 32 to make the lower lid 20 close the dust extraction port 11. Additionally, in the second position, the hook 31 is disengaged from the snapping part 32 to enable the lower lid 20 to rotate with respect the box body 10.

Thus, after the button 50 is pressed down, the hook 31 is disengaged from the snapping part 32 to make the lower lid 20 rotate to open the dust extraction port 11 to discharge the pollutants, which is a simple dust exhaust manner.

Specifically, the hook 31 includes a snapping surface 311 facing upwards, the snapping part 32 includes a snapping bar 321, and in the first position, the snapping bar 321 abuts against the snapping surface 311.

In some embodiments, the button 50 includes a press board 52, and the rotating shaft 51 is fixed in a middle position of the press board 52. The press board 52 includes a first swing end 521 and a second swing end 522 located at two opposite sides of the rotating shaft 51 respectively. The hook 31 forms the first swing end 521, the first swing end 521 swings towards a direction away from the box body 10, and the second swing end 522 swings towards a direction approaching the box body 10. The box body 10 defines a void space 18 available for the second swing end 522 to swing.

As a result, the void space 18 can prevent the button 50 from interfering with the box body 10 during the rotation.

In some embodiments, the top of the box body 10 defines an opening in communication with the dust extraction port 11, and the dust collection box 100 further includes an upper lid 60 detachably arranged to the top of the box body 10 and covering the opening.

Thus, after the upper lid 60 is removed, the filter device 40 is easily taken out from the box body 10 and mounted into the box body 10.

In some embodiments, the upper lid 60 is connected with the box body 10 through a second snap structure 70. Thus, the upper lid 60 can be easily removed.

Reference throughout this specification to "an embodiment," "some embodiments," "an exemplary embodiment," "an example," "specific examples" or "some examples" means that a particular feature, structure, material, or characteristic described in connection with the embodiment or example is included in at least one embodiment or example of the present disclosure. Thus, the appearances of the above phrases throughout this specification are not necessarily referring to the same embodiment or example of the present disclosure. Furthermore, the particular features, structures, materials, or characteristics may be combined in any suitable manner in one or more embodiments or examples.

Although embodiments of the present disclosure have been shown and illustrated, it shall be understood by those skilled in the art that various changes, modifications, alternatives and variations without departing from the principle of the present disclosure are acceptable. The scope of the present disclosure is defined by the claims or the like.

What is claimed is:

1. A dust collection box, comprising:

a box body comprising a dust extraction port at a bottom of the box body, wherein a top of the box body defines an opening in communication with the dust extraction port;

a lower lid comprising a first lateral portion and a second lateral portion opposite to each other, the first lateral portion being rotatably connected with the box body to enable the lower lid to open or close the dust extraction port, the second lateral portion being snap-fitted with the box body through a first snap structure;

an upper lid detachably arranged to the top of the box body and covering the opening; and a button arranged on a side surface of the dust collection box, wherein the button is configured be depressible such that when the button is pushed, the lower lid rotates downward along the first lateral portion to expose the dust extraction port; and, wherein when the lower lid closes, the dust extraction port is enclosed by the lower lid.

2. The dust collection box according to claim 1, wherein the lower lid comprises a bottom wall and a lateral wall extending from an edge of the bottom wall, and the bottom wall and the lateral wall enclose a groove; and, wherein when the lower lid close, the bottom of the box body stretches into the groove, and the lateral wall surrounds the bottom of the box body.

3. The dust collection box according to claim 2, wherein the box body comprises a dust collecting chamber in communication with the dust extraction port;

the lower lid comprises a bump fixed on the bottom wall and received in the groove; and, wherein when the lower lid closes, the bump extends into the dust collecting chamber and fills a bottom of the dust collecting chamber.

4. The dust collection box according to claim 2, wherein the box body comprises an outer peripheral surface and a bottom surface connected with the outer peripheral surface, and a receiving groove is defined at a joint of the outer peripheral surface and the bottom surface; and, wherein when the lower lid closes, the lateral wall is received in the receiving groove, and the outer peripheral surface is smoothly transitioned to an outer side of the lateral wall.

5. The dust collection box according to claim 1, wherein the button comprises a rotating shaft, and the button is rotatably arranged to the box body through the rotating shaft; and wherein the first snap structure comprises a hook formed at an end of the button and a snapping part formed at the second lateral portion.

6. The dust collection box according to claim 5, wherein the button is configured to swing, with respect to the box body, between a first position, where the hook is snap-fitted with the snapping part to make the lower lid enclose the dust extraction port, and a second position.

7. The dust collection box according to claim 5, wherein the hook comprises a snapping surface facing upwards, the snapping part comprises a snapping bar, and in the first position, the snapping bar abuts against the snapping surface.

8. The dust collection box according to claim 5, wherein the button comprises a press board, and the rotating shaft is fixed in a middle position of the press board.

9. The dust collection box according to claim 8, wherein the press board comprises a first swing end and a second swing end located at two opposite sides of the rotating shaft respectively; and, wherein the hook forms the first swing end, the first swing end swings towards a direction away from the box body, and the second swing end swings towards a direction approaching the box body; and the box body defines a void space available for the second swing end to swing.

10. The dust collection box according to claim 1, wherein the upper lid is connected with the box body through a second snap structure.

11. A robot vacuum cleaner, comprising:

a casing; and a dust collection box comprising:

a box body comprising a dust extraction port at a bottom of the box body, wherein a top of the box body defines an opening in communication with the dust extraction port;

a lower lid comprising a first lateral portion and a second lateral portion opposite to each other, the first lateral portion being rotatably connected with the box body to enable the lower lid to open or close the dust extraction port, the second lateral portion being snap-fitted with the box body through a first snap structure;

an upper lid detachably arranged to the top of the box body and covering the opening; and a button arranged on a side surface of the dust collection box, wherein the button is configured be depressible such that when the button is pushed, the lower lid rotates downward along the first lateral portion to expose the dust extraction port; and, wherein when the lower lid closes, the dust extraction port is enclosed by the lower lid.

12. The robot vacuum cleaner according to claim 11, wherein the lower lid comprises a bottom wall and a lateral wall extending from an edge of the bottom wall, and the bottom wall and the lateral wall enclose a groove; and, wherein when the lower lid close, the bottom of the box body stretches into the groove, and the lateral wall surrounds the bottom of the box body.

13. The robot vacuum cleaner according to claim 12, wherein the box body comprises a dust collecting chamber in communication with the dust extraction port;

the lower lid comprises a bump fixed on the bottom wall and received in the groove; and, wherein when the lower lid closes, the bump extends into the dust collecting chamber and fills a bottom of the dust collecting chamber.

14. The robot vacuum cleaner according to claim 13, wherein the box body comprises an outer peripheral surface and a bottom surface connected with the outer peripheral surface, and a receiving groove is defined at a joint of the outer peripheral surface and the bottom surface; and, wherein when the lower lid closes, the lateral wall is received in the receiving groove, and the outer peripheral surface is smoothly transitioned to an outer side of the lateral wall; and the button comprises a rotating shaft, and the button is rotatably arranged to the box body through the rotating shaft; and wherein the first snap structure comprises a hook formed at an end of the button and a snapping part formed at the second lateral portion.

15. The robot vacuum cleaner according to claim 14, wherein the button is configured to swing, with respect to the box body, between a first position, where the hook is snap-fitted with the snapping part to make the lower lid enclose the dust extraction port, and a second position.

16. The robot vacuum cleaner according to claim 14, wherein the hook comprises a snapping surface facing upwards, the snapping part comprises a snapping bar, and in the first position, the snapping bar abuts against the snapping surface.

17. The robot vacuum cleaner according to claim 14, wherein the button comprises a press board, and the rotating shaft is fixed in a middle position of the press board.

18. The robot vacuum cleaner according to claim 17, wherein the press board comprises a first swing end and a second swing end located at two opposite sides of the rotating shaft respectively; and, wherein the hook forms the first swing end, the first swing end swings towards a direction away from the box body, and the second swing end swings towards a direction approaching the box body; and the box body defines a void space available for the second swing end to swing.

19. A robot vacuum cleaner, comprising:

a casing; and a dust collection box comprising:

a box body comprising a dust extraction port at a bottom of the box body;

a lower lid comprising a first lateral portion and a second lateral portion opposite to each other, the first lateral portion being rotatably connected with the box body to enable the lower lid to open or close the dust extraction port, the second lateral portion being snap-fitted with the box body through a first snap structure; and a button arranged on a side surface of the dust collection box, wherein the button is configured be depressible such that when the button is pushed, the lower lid rotates downward along the first lateral portion to expose the dust extraction port, wherein the button comprises a rotating shaft, and a press board, wherein the rotating shaft is fixed in a middle position of the press board, and the button is rotatably arranged to the box body through the rotating shaft;

the button is configured to swing, with respect to the box body, between a first position, where the hook is snap-fitted with the snapping part to make the lower lid enclose the dust extraction port, and a second position; and wherein the first snap structure comprises a hook formed at an end of the button and a snapping part formed at the second lateral portion; and, wherein when the lower lid closes, the dust extraction port is enclosed by the lower lid.

* * * * *